US011639066B2

(12) United States Patent
Baumeister et al.

(10) Patent No.: US 11,639,066 B2
(45) Date of Patent: May 2, 2023

(54) PRINTING PRESS WITH CHARGING DEVICE

(71) Applicant: KOENIG & BAUER AG, Würzburg (DE)

(72) Inventors: Thomas Baumeister, Würzburg (DE); Frank Denninger, Hettstadt (DE); Christian Schlund, Birkenfeld (DE); Simon Stahl, Wiesenbronn (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/802,552

(22) PCT Filed: Jun. 7, 2021

(86) PCT No.: PCT/EP2021/065113
§ 371 (c)(1),
(2) Date: Aug. 26, 2022

(87) PCT Pub. No.: WO2022/028751
PCT Pub. Date: Feb. 10, 2022

(65) Prior Publication Data

US 2023/0078057 A1 Mar. 16, 2023

(30) Foreign Application Priority Data

Aug. 7, 2020 (DE) ..... 10 2020 120 882.0

(51) Int. Cl.
*B41J 11/00* (2006.01)
*B41J 25/00* (2006.01)

(52) U.S. Cl.
CPC ..... *B41J 11/007* (2013.01); *B41J 11/0015* (2013.01); *B41J 2025/008* (2013.01)

(58) Field of Classification Search
CPC .. B41J 11/007; B41J 11/0015; B41J 2025/008
See application file for complete search history.

(56) References Cited

U.S. PATENT DOCUMENTS 10,343,420 B2 7/2019 Young et al.
2002/0027588 A1 3/2002 Kiyama et al.
(Continued)

FOREIGN PATENT DOCUMENTS

DE 19923655 A1 12/2000
EP 2371561 A2 10/2011

OTHER PUBLICATIONS

Chinese Office Action received in corresponding Chinese Application No. 202180016945.0 dated Jan. 19, 2023.
(Continued)

*Primary Examiner* — Justin Seo
(74) *Attorney, Agent, or Firm* — Mattingly & Malur, PC

(57) ABSTRACT

In some examples, a printing press includes a support element with a circulatingly movable contact surface for contacting a printing substrate. An ink jet print head includes an ejection opening arranged to be directed at the support element. Additionally, the printing press includes a charging device that includes a charging electrode, which is arranged to be directed at the contact surface. The charging device further includes a counter-electrode, and the movable contact surface is at least partially arranged between the charging electrode and the counter-electrode of the charging device. A smallest distance between the charging electrode and the movable contact surface is greater than a smallest distance between the ejection opening of the ink jet print head and the contact surface. For example, the smallest distance between the charging electrode and the contact surface may be at least 50 mm.

15 Claims, 5 Drawing Sheets

(56) References Cited

U.S. PATENT DOCUMENTS

| | | | | |
|---|---|---|---|---|
| 2005/0212871 | A1 | 9/2005 | Kadomatsu et al. | |
| 2014/0028750 | A1* | 1/2014 | Fletcher | B41J 13/0009 347/16 |
| 2014/0184712 | A1 | 7/2014 | Fletcher et al. | |
| 2014/0267501 | A1 | 9/2014 | Ramesh et al. | |
| 2017/0326890 | A1 | 11/2017 | McCallum et al. | |
| 2018/0326754 | A1 | 11/2018 | Young et al. | |

OTHER PUBLICATIONS

International Search Report of PCT/EP2021/065113 dated Sep. 8, 2021.

* cited by examiner

PRINTING PRESS WITH CHARGING DEVICE

CROSS-REFERENCES TO RELATED APPLICATIONS

This application is the US national phase, under 35 USC § 371, of PCT/EP2021/065113, filed on Jun. 7, 2021, published as WO 2022/028751 A1 on Feb. 10, 2022, and claiming priority to DE 10 2020 120 882.0, filed Aug. 7, 2020, the disclosures of which are expressly incorporated by reference herein in their entireties.

TECHNICAL FIELD

Examples herein relate to a printing press including at least one circulatingly movable support element that includes a circulatingly movable contact surface intended for contact with a printing substrate. The printing press further includes at least one first print head configured as an ink jet print head, with at least one ejection opening is arranged so as to be directed at the at least one support element. Additionally, the printing press includes at least one first charging device that includes at least one charging electrode, which is arranged so as to be directed at the contact surface. Further, the at least one first charging device includes at least one counter-electrode, and the movable contact surface is at least partially arranged between the at least one charging electrode and the at least one counter-electrode of the at least one first charging device.

BACKGROUND

A sheet-fed printing press is known from US 2017/0326890 A1, which comprises a curved conveyor belt for sheet travel, wherein a roller is provided for charging, which is in contact with the conveyor belt or a sheet.

A device for printing onto sheets is known from EP 2 371 561 A2, which comprises a charging device arranged beneath a conveyor belt.

A sheet-fed printing press is known from US 2005/0212871 A1, which comprises a charging device acting from above only on sheets or, alternatively, a charging device acting from beneath on a conveyor belt.

A printing press comprising a circulatingly movable support element and an ink jet print head is known from U.S. Pat. No. 10,343,420 B2, comprising a charging device including a charging electrode and a neutralizing device including a grounded electrode. The charging electrode is arranged so as to be in contact with the substrate or close to the substrate.

A device for reducing electrical charging in an ink jet printing press is known from US 2014/0 267 501 A1.

A device for treating substrate surfaces by means of corona discharge is known from DE 199 23 655 A1.

A device is known from US 2002/0 027 588 A1, which can be used to monitor whether substrate sheets tacked to a conveyor belt as a result of an electrical charge detach properly from this conveyor belt again.

An ink jet printing press is known from US 2014/0184712 A1, comprising a charging device that includes two rollers forming a nip. In addition, a discharging device is provided.

SUMMARY

It is an object herein to provide a printing press comprising a charging device.

This object is achieved in some examples of a printing press including at least the first charging device in which a smallest distance between at least one charging electrode of the first charging device and the movable contact surface is greater than a smallest distance between an ejection opening of the at least one first print head and the contact surface. In some examples, the smallest distance between the at least one charging electrode of the first charging device and the contact surface is at least 50 mm.

An ink jet printing press comprises at least one circulatingly movable support element, which includes a circulatingly movable contact surface intended for contact with a printing substrate. The printing press comprises at least one first ink jet print head, whose at least one ejection opening is arranged so as to be directed at the at least one support element and, in particular, at the contact surface. The printing press comprises at least one first charging device, in particular for electrostatically charging printing substrate. The at least one first charging device comprises at least one, in particular upper, charging electrode, which is in particular arranged so as to be directed from above at the contact surface. The at least one first charging device comprises at least one, in particular lower, counter-electrode. The contact surface is at least partially arranged between the at least one charging electrode and the at least one counter-electrode of the at least one first charging device. A smallest distance between the at least one charging electrode, and preferably each charging electrode, of the first charging device and the contact surface is greater than a smallest distance between an ejection opening, and preferably each ejection opening, of the at least one first print head and the contact surface. An advantage of such a printing press is in particular that printing substrate, in particular sheets, can be fixed at the contact surface, without coming in contact with the surface of the printing substrate that is to be printed or has already been printed. In this way, it is possible to create a high-quality print image, while at the same time protecting the printing substrate. In particular in the case of multiple print heads, which are arranged spaced apart from one another in succession along a transport path intended for a transport of printing substrate, it can be ensured that register-accurate printing without smearing can be achieved. Moreover, it is possible, at least in the region of the at least one print head, to transport the printing substrate with at least reduced vacuum pressure, or without vacuum pressure, so that a respective trajectory of ink droplets is not negatively influenced by air flows. Additionally, wear of a conveyor belt can be reduced by using vacuum pressure that is at least reduced.

The smallest distance between the at least one charging electrode, and preferably each charging electrode, of the first charging device is at least 50 mm. In a refinement, the printing press is preferably characterized in that the smallest distance between the at least one charging electrode, and preferably each charging electrode, of the first charging device and the contact surface is at least 60 mm, more preferably at least 65 mm, and still more preferably at least 70 mm. This successfully ensures a particularly reliable transport of the printing substrate. In addition, a high electric field strength and/or high charging can be generated, and nonetheless an electrical breakdown can be avoided.

In an alternative or additional refinement, the printing press is preferably characterized in that at least one first position sensor is provided, by means of which a height of a printing substrate relative to the contact surface can be ascertained. In this way, an automated emergency-off function and/or control of the charge are made possible. In an alternative or additional refinement, the printing press is preferably characterized in that first the at least one first charging device, and thereafter the at least one first print head, are arranged along a transport path intended for a transport of printing substrate. In this way, it is ensured that the printing substrate does not damage the print head since the printing substrate rests against the contact surface. In an alternative or additional refinement, the printing press is preferably characterized in that at least one detection zone of the at least one first position sensor is arranged along the transport path intended for a transport of printing substrate, downstream from the at least one first print head. In this way, control of the charge can take place in a particularly favorable manner since a satisfactory measurement result downstream from the print head allows an at least satisfactory condition to be inferred in the region of the print head.

In an alternative or additional refinement, the printing press is preferably characterized in that at least one second charging device is arranged along the transport path intended for a transport of printing substrate, downstream from the at least one first print head and/or downstream from the at least one detection zone of the at least one first position sensor, and at least one second print head is arranged thereafter.

In an alternative or additional refinement, the printing press is preferably characterized in that a voltage of at least 25 kV, more preferably at least 30 kV, and still more preferably at least 35 kV, and independently thereof preferably no more than 45 kV, and more preferably no more than 40 kV, is present between the at least one charging electrode and the at least one counter-electrode of the first charging device.

In an alternative or additional refinement, the printing press is preferably characterized in that a transport path intended for a transport of printing substrate extends between the at least one circulating contact surface and the at least one charging electrode of the at least one first charging device. In this way, an alignment of the field lines of the electrical field in the area of the boundary between the contact surface and the printing substrate is optimized.

In an alternative or additional refinement, the printing press is preferably characterized in that the at least one first charging device is configured as a DC charging device. In this way, particularly efficient and uniform charging is achieved.

In an alternative or additional refinement, the printing press is preferably characterized in that at least one first field strength sensor for measuring an electric field strength is arranged in particular along the transport path intended for the transport of printing substrate, downstream from the at least one first charging device and/or downstream from the at least one first print head.

In an alternative or additional refinement, the printing press is preferably characterized in that a transport path intended for the transport of printing substrate extends in a substantially flat manner, at least from the charging electrode of the first charging device to the at least one second print head. This also allows thick printing substrates, for example corrugated cardboard sheets, to be transported.

In an alternative or additional refinement, the printing press is preferably characterized in that the at least one circulatingly movable support element is configured as a conveyor belt and/or as a suction conveyor belt. In an alternative or additional refinement, the printing press is preferably characterized in that the printing press comprises at least one bracing device, which includes a sliding surface that braces the at least one conveyor belt and, more preferably, is at least partially metallic, and that the at least one bracing device is arranged so as to act as the at least one counter-electrode.

In an alternative or additional refinement, the printing press is preferably characterized in that the printing press is configured as a sheet-fed printing press and/or comprises at least one sheet feeder for sheet-format printing substrate, which more preferably comprises a singulating device arranged beneath a piling region intended for a sheet pile, in particular for singulating sheet-format printing substrate from at least one pile of sheets from beneath.

In an alternative or additional refinement, the printing press is preferably characterized in that the printing press is configured as a web-fed printing press and/or comprises at least one roll unwinding device for web-format printing substrate.

In an alternative or additional refinement, the printing press is preferably characterized in that the at least one circulatingly movable support element is configured as a central cylinder.

BRIEF DESCRIPTION OF THE DRAWINGS

Exemplary embodiments of the invention are illustrated in the drawings and will be described in greater detail below. The drawings show.

DETAILED DESCRIPTION

Figure 1:
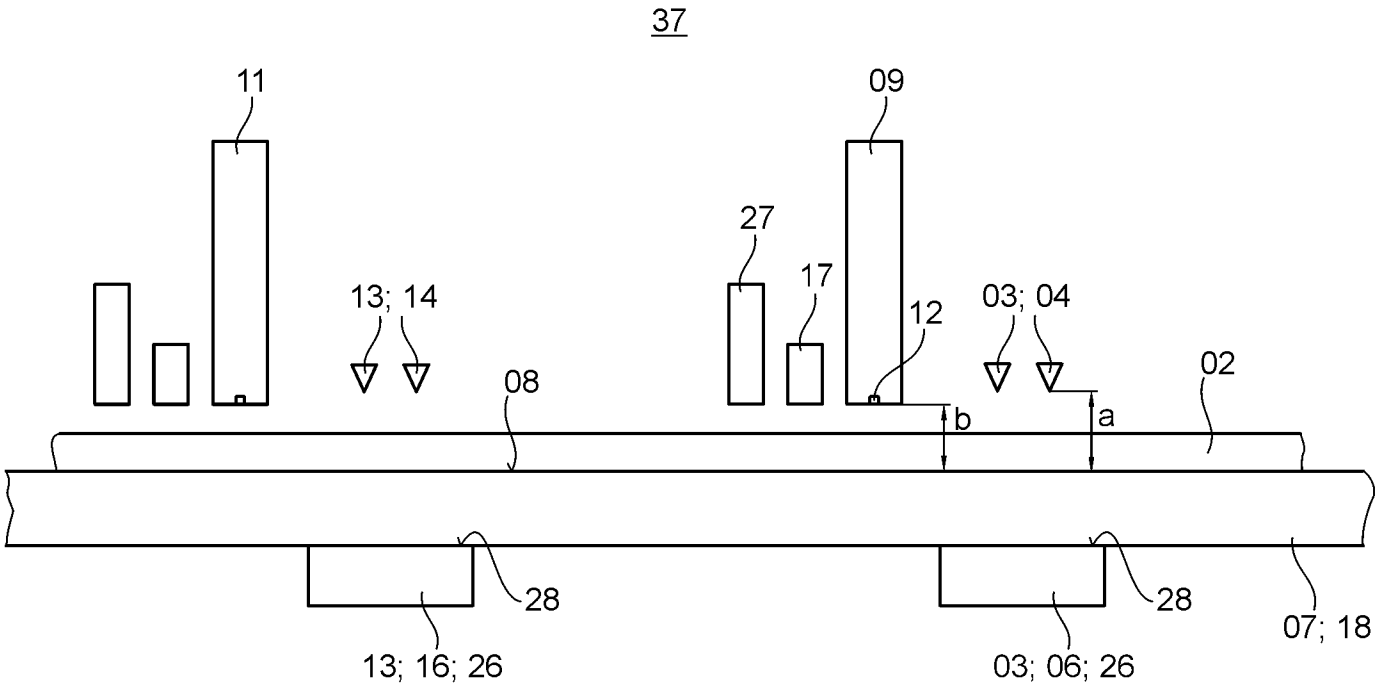
FIG. 1 a schematic illustration of an area of a printing unit comprising print heads and charging devices.

A printing press 01 is preferably configured as an ink jet printing press 01. The printing press 01 is in particular used to print onto printing substrate 02. The printing press 01 is, for example, configured as a sheet-fed printing press 01, that is, as a printing press 01 for sheet-format printing substrate 02. The printing press 01 is, for example, configured as a corrugated cardboard sheet-fed printing press 01, that is, as a printing press 01 for printing onto sheets 02 made of corrugated cardboard. As an alternative, the printing press 01 is configured as a web-fed printing press 01. To the extent that, above and below, features are described based on an embodiment as a sheet-fed printing press 01, these also apply to a general printing press 01, in particular also for a web-fed printing press 01, provided this does not result in any contradictions.

Preferably, a transport path for a transport of printing substrate 02 through the printing press 01 is provided. The transport path intended for the transport of printing substrate 02 is in particular the spatial area that the printing substrate 02, if present, regularly takes up and/or would take up, optionally at least temporarily. In the case of a curved transport path, a transport direction T is preferably in each case the direction T that runs tangential to a segment and/or point of the intended transport path closest to a respective reference point and that is provided for the transport of the printing substrate 02 at this segment and/or point. This respective reference point is preferably situated at the point and/or at the component that is being related to the transport direction T. The transport direction T thus preferably in each case extends along the transport path intended for printing substrate 02. A transverse direction A is preferably a direction A that extends orthogonally to the transport direction T and horizontally. A working width of the printing press 01 is preferably a dimension that preferably extends in the transverse direction A. The working width of the printing press 01 preferably corresponds to a maximum width that a printing substrate 02 is permitted to have for the printing press 01 to still be able to be print it, that is, in particular a maximum sheet width and/or web width and/or width of the printing substrate 02 that the printing press 01 is able to process. The width of a printing substrate 02 shall, in particular, be understood to mean its dimension in the transverse direction A. The working width of the printing press 01 is, for example, at least 20 cm, preferably at least 50 cm, more preferably at least 100 cm, still more preferably at least 150 cm, still more preferably at least 200 cm, and still more preferably at least 250 cm.

The printing press 01 comprises at least one circulatingly movable support element 07, which includes a circulatingly movable contact surface 08 intended for contact with a printing substrate 02. Depending on the configuration of the printing press 01, the at least one support element 07 is, for example, configured to be flexible, in particular as a conveyor belt 18, or rigid, in particular as a cylinder 29, in particular a central cylinder 29. The printing press 01 comprises at least one first print head 09, which is in particular configured as an ink jet print head 09. The at least one first print head 09 preferably includes at least one ejection opening 12, which is in particular used to eject ink droplets in a targeted manner. The at least one first print head 09 is preferably configured as a print head 09 operating according to the drop-on-demand principle. Preferably, the at least one ejection opening 12 of the at least one first print head 09 is arranged so as to be directed at the at least one support element 07, and in particular at the contact surface 08 of this at least one support element 07. The at least one support element 07 is in particular used to hold the printing substrate 02 in a defined position while the ink is being applied thereto. Preferably, the contact surface 08 is a contact surface 08 that can be moved relative to the at least one first print head 09. Preferably, the contact surface 08 is a contact surface 08 that is circulatingly movable together with the printing substrate 02.

The printing press 01 preferably comprises at least one charging device 03; 13, in particular for electrostatically charging printing substrate 02. More preferably, the printing press 01 comprises at least one first charging device 03, and still more preferably additionally at least one second charging device 13. The respective at least one charging device 03; 13 is in particular used to fix printing substrate 02 relative to the at least one support element 07.

The at least one first charging device 03 comprises at least one charging electrode 04, which is arranged so as to be directed at the contact surface 08. Preferably, the at least one first charging electrode 04 is at least partially arranged above the contact surface 08 and/or arranged so as to be directed from above at the contact surface 08. The at least one first charging device 03 preferably comprises at least one counter-electrode 06. The at least one counter-electrode 06 is preferably arranged beneath the at least one contact surface 08 and/or at least beneath parts of the at least one support element 07. Preferably, the transport path intended for a transport of printing substrate 02 extends between the at least one circulatingly movable contact surface 08 and the at least one charging electrode 04 of the at least one first charging device 03. Preferably, the contact surface 08 is at least partially arranged between the at least one charging electrode 04 and the at least one counter-electrode 06 of the at least one first charging device 03.

Preferably, the at least one first charging device 03 is configured such that at least one side of the printing substrate 02, and more preferably the entire printing substrate 02, can be electrostatically charged without contact with the first charging device 03. In this way, the corresponding surface of the printing substrate 02 can be treated gently, in particular in the case of an interposed charging process. Preferably, a smallest distance a between the at least one charging electrode 04 of the at least one first charging device 03 and the contact surface 08 is greater than a smallest distance b between an ejection opening 12, and preferably each ejection opening 12, of the at least one first print head 09 and the contact surface 08. More preferably, the smallest distance a between the at least one charging electrode 04, and preferably each charging electrode 04, of the at least one first charging device 03 and the contact surface 08 is at least 50 mm, still more preferably at least 60 mm, still more preferably at least 65 mm, and still more preferably at least 70 mm.

In an alternative or additional refinement, the printing press 01 is preferably characterized in that at least one first position sensor 17 is provided, by means of which a height position of a printing substrate 02 relative to the contact surface 08 can be ascertained. The at least one first position sensor 17 is preferably configured as a laser measuring device 17, in particular for triangulation measurement.

In an alternative or additional refinement, the printing press 01 is preferably characterized in that first the at least one first charging device 03, and thereafter the at least one first print head 09, are arranged along a transport path intended for a transport of printing substrate 02. In an alternative or additional refinement, the printing press 01 is preferably characterized in that at least one detection zone of the at least one first position sensor 17 and/or the at least one first position sensor 17 are arranged along the transport path intended for the transport of printing substrate 02, downstream from the at least one first print head 09.

In an alternative or additional refinement, the printing press 01 is preferably characterized in that the at least one first charging device 03 is configured as a DC charging device 03. This means in particular that a sign of the voltage present at the particular charging electrode 04 does not change during operation. Preferably, a voltage of at least 25 kV, preferably at least 30 kV, and more preferably at least 35 kV, and independently thereof preferably of no more than 45 kV, and more preferably no more than 40 kV, is present between the at least one charging electrode 04 and the at least one counter-electrode 06 of the first charging device 03, at least in one operating mode of the printing press 01. In an alternative or additional refinement, the printing press 01 is preferably characterized in that at least one first field strength sensor 27 for measuring an electric field strength is arranged in particular along the transport path intended for the transport of printing substrate 02, downstream from the at least one first charging device 03 and/or downstream from the at least one first print head 09. This at least one first field strength sensor 27 is preferably connected by circuitry to the at least one first charging device 03 such that they form a control loop, in particular for controlling the electric field strength and/or the voltage present at the at least one charging electrode 04 and/or a vacuum pressure of the conveyor belt 18 prevailing in the area of the at least one second print head 11. Preferably, alternatively or additionally, the at least one first position sensor 17 is connected by circuitry to the at least one first charging device 03 such that they are part of a control loop, in particular for controlling the electric field strength and/or the voltage present at the at least one charging electrode 04 and/or a vacuum pressure of the conveyor belt 18 prevailing in the area of the at least one second print head 11. In this way, optimized charging can take place. As an alternative or in addition, the at least one first position sensor 17 is connected by circuitry to a preferably automated emergency-off function for terminating a transport of printing substrate. In this way, damage to, for example, the at least one first print head 09 can preferably be prevented.

In an alternative or additional refinement, the printing press 01 is preferably characterized in that at least one second charging device 13 is arranged along the transport path intended for a transport of printing substrate 02, downstream from the at least one first print head 09 and/or downstream from the at least one detection zone of the at least one first position sensor 17, and at least one second print head 11 is arranged thereafter.

The at least one second charging device 14 comprises at least one charging electrode 14, which is arranged so as to be directed at the contact surface 08. Preferably, the at least one second charging electrode 14 is at least partially arranged above the contact surface 08 and/or arranged so as to be directed from above at the contact surface 08. The at least one second charging device 13 preferably comprises at least one counter-electrode 16. The at least one counter-electrode 16 is preferably arranged beneath the at least one contact surface 08 and/or at least beneath parts of the at least one support element 07. Preferably, the transport path intended for a transport of printing substrate 02 extends between the at least one circulatingly movable contact surface 08 and the at least one charging electrode 14 of the at least one second charging device 13. Preferably, the contact surface 08 is at least partially arranged between the at least one charging electrode 14 and the at least one counter-electrode 16 of the at least one second charging device 13.

Preferably, the at least one second charging device 13 is configured such that at least one side of the printing substrate 02, and more preferably the entire printing substrate 02, can be electrostatically charged without contact with the second charging device 13. In this way, the corresponding surface of the printing substrate 02 can be treated gently, in particular in the case of an interposed charging process. Preferably, a smallest distance a between the at least one charging electrode 14 of the at least one second charging device 13 and the contact surface 08 is greater than a smallest distance b between an ejection opening 12, and preferably each ejection opening 12, of the at least one second print head 11 and the contact surface 08. More preferably, the smallest distance a between the at least one charging electrode 14, and in particular each charging electrode 14, of the at least one second charging device 13 and the contact surface 08 is at least 50 mm, more preferably at least 60 mm, still more preferably at least 65 mm, and still more preferably at least 70 mm.

In an alternative or additional refinement, the printing press 01 is preferably characterized in that at least one second position sensor 34 is provided, by means of which a height position of a printing substrate 02 relative to the contact surface 08 can be ascertained. The at least one second position sensor 34 is preferably configured as a laser measuring device 34, in particular for triangulation measurement.

In an alternative or additional refinement, the printing press 01 is preferably characterized in that first the at least one second charging device 13, and thereafter the at least one second print head 11, are arranged along a transport path intended for a transport of printing substrate 02. In an alternative or additional refinement, the printing press 01 is preferably characterized in that at least one detection zone of the at least one second position sensor 34 and/or the at least one second position sensor 34 are arranged along the transport path intended for the transport of printing substrate 02, downstream from the at least one second print head 11.

In an alternative or additional refinement, the printing press 01 is preferably characterized in that the at least one second charging device 13 is configured as a DC charging device 13. This means in particular that a sign of the voltage present at the particular charging electrode 14 does not change during operation. Preferably, a voltage of at least 25 kV, more preferably at least 30 kV, and still more preferably at least 35 kV, and independently thereof preferably of no more than 45 kV, and more preferably no more than 40 kV, is present between the at least one charging electrode 14 and the at least one counter-electrode 16 of the second charging device 13, at least in one operating mode of the printing press 01. In an alternative or additional refinement, the printing press 01 is preferably characterized in that at least one second field strength sensor 36 for measuring an electric field strength is arranged in particular along the transport path intended for the transport of printing substrate 02, downstream from the at least one second charging device 13 and/or downstream from the at least one second print head 11. This at least one second field strength sensor 36 is preferably connected by circuitry to the at least one second charging device 13 such that they form a control loop, in particular for controlling the electric field strength and/or the voltage present at the at least one charging electrode 14 and/or a vacuum pressure of the conveyor belt 18 prevailing in the area of the at least one second print head 11. Preferably, alternatively or additionally, the at least one second position sensor 34 is connected by circuitry to the at least one second charging device 13 such that they form a control loop, in particular for controlling the electric field strength and/or the voltage present at the at least one charging electrode 14 and/or a vacuum pressure of the conveyor belt 18 prevailing in the area of the at least one second print head 11. In this way, optimized charging can take place. As an alternative or in addition, the at least one second position sensor 34 is connected by circuitry to a preferably automated emergency-off function for terminating a transport of printing substrate. In this way, damage to, for example, the at least one second print head 11 can preferably be prevented.

In one exemplary embodiment, the at least one circulatingly movable support element 07 is configured as a conveyor belt 18. Preferably, the transport path intended for the transport of printing substrate 02 extends in a substantially flat manner, and still more preferably in a completely flat manner, at least from the charging electrode 04 of the first charging device 03 to the at least one first print head 09. A substantially flat section of a transport path intended for printing substrate 02 in this context shall be understood to mean a section that has a minimum radius of curvature of at least 2 meters, more preferably at least 5 meters, and still more preferably at least 10 meters, and still more preferably at least 50 meters. A completely flat section has an infinitely large radius of curvature and is thus likewise substantially flat and therefore likewise has a minimum radius of curvature of at least 2 meters. More preferably, the printing press 01 comprises at least one second charging device 13 along the transport path intended for the transport of printing substrate 02, downstream from the at least one first print head 09, and thereafter at least one second print head 11. Preferably, the transport path intended for the transport of printing substrate 02 extends in a substantially flat manner, and still more preferably in a completely flat manner, at least from the charging electrode 04 of the first charging device 03 to the at least one second print head 11.

In an alternative or additional refinement, the printing press 01 is preferably characterized in that the printing press 01 comprises at least one bracing device 26, which includes a sliding surface 28 that braces the at least one conveyor belt 18 and preferably is metallic, and that the at least one bracing device 26 is arranged so as to act as the at least one counter-electrode 06. This bracing device 28 extends, for example, at least in the region of the at least one first charging electrode 03 along the transport path intended for the transport of printing substrate 02. In at least one other region of the transport path intended for the transport of printing substrate 02, for example, an in particular electrically neutral or grounded bracing device 31 that is separate therefrom is provided. Alternatively, the bracing device 28 acting as the counter-electrode 06 extends along the transport path intended for the transport of printing substrate 02 beyond the region of the at least one charging electrode 03; 13.

In an alternative or additional refinement, the printing press 01 is preferably characterized in that the at least one conveyor belt 18 is configured, at least in areas, as a suction conveyor belt 18. A suction conveyor belt 18 shall be understood to mean a conveyor belt 18 that has openings and is guided via at least one suction box 32. The at least one suction box 32 is preferably connected to a vacuum source 33, for example a pump 33. The vacuum pressure is then passed on through the openings in the suction conveyor belt 18 and is used to hold the printing substrate 02 on the contact surface 08. Preferably, the conveyor belt 18, along the transport path intended for the transport of printing substrate 02, is arranged so as to be exclusively guided by guide elements that are fixed with respect to rotary movements, at least between the first charging device 03 and the at least one first print head 09, and more preferably the at least one second print head 11. In particular, no supporting rolls are preferably arranged in this area.

For example, no vacuum pressure that acts from beneath on the conveyor belt 18 is provided in at least one idle region around the at least one print head 09 and/or around the at least one second print head 11, even if the conveyor belt 18 is configured and/or operated in other locations as a suction conveyor belt 18. Preferably, at least one first such idle region extends, proceeding from the at least one first print head 09, counter to the transport path intended for the transport of printing substrate 02, over at least 5 cm, more preferably at least 8 cm, and still more preferably at least 10 cm, and independently thereof, proceeding from the at least one first print head 09, along the transport path intended for the transport of printing substrate 02, over at least 5 cm, more preferably at least 8 cm, and still more preferably at least 10 cm. Preferably, at least one second such idle region extends, proceeding from the at least one second print head 11, counter to the transport path intended for the transport of printing substrate 02, over at least 5 cm, more preferably at least 8 cm, and still more preferably at least 10 cm, and independently thereof, proceeding from the at least one second print head 11, along the transport path intended for the transport of printing substrate 02, over at least 5 cm, more preferably at least 8 cm, and still more preferably at least 10 cm.

Figure 2:
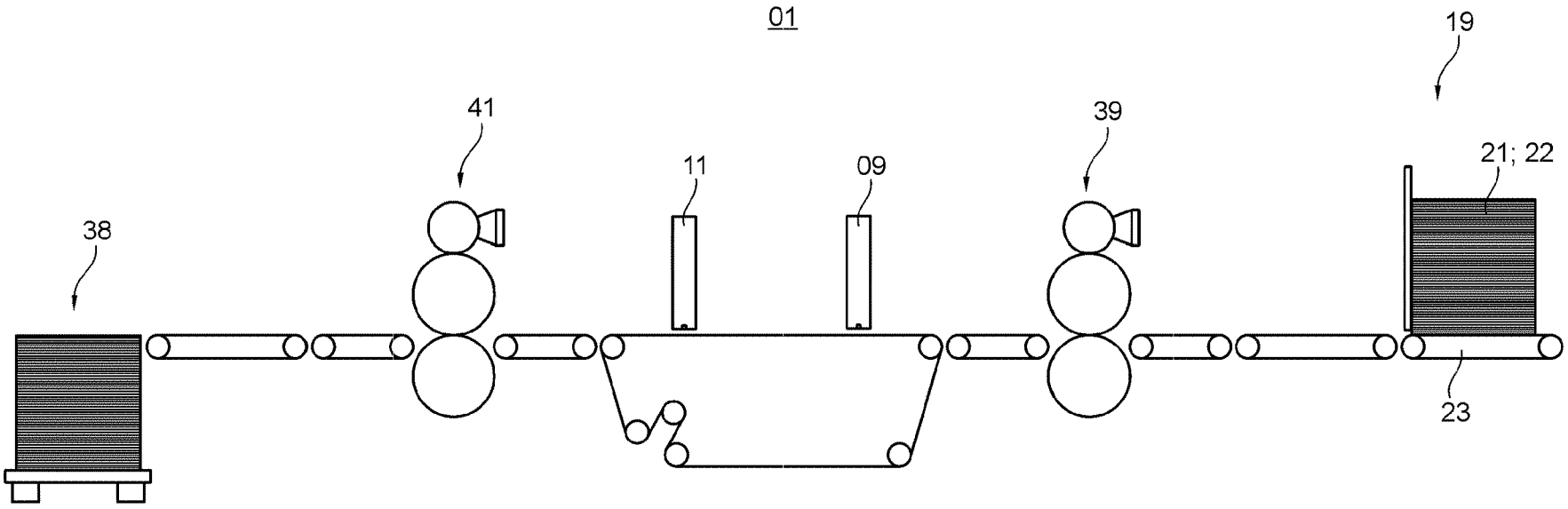
FIG. 2 a schematic illustration of a sheet-fed printing press comprising a conveyor belt as a support element.
Figure 3:
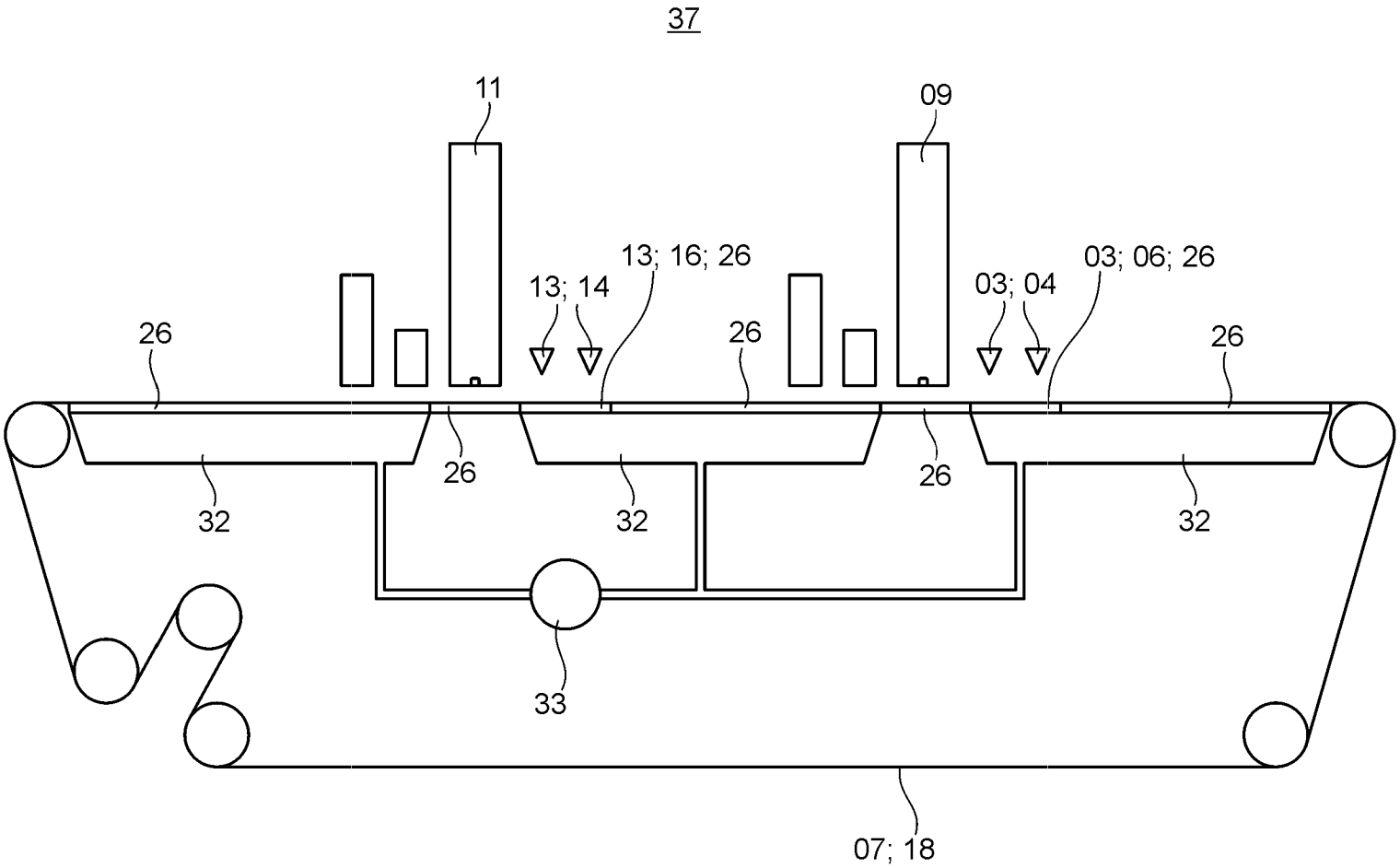
FIG. 3 a schematic illustration of a printing unit comprising print heads, charging devices and suction boxes.

Preferably, the printing press 01 is configured as a sheet-fed printing press 01 and/or the printing press 01 comprises at least one sheet feeder 19 for sheet-format printing substrate 02, which more preferably comprises a singulating device 23 that is arranged beneath a piling region 22 intended for a sheet pile 21, in particular for singulating sheet-format printing substrate 02 from at least one sheet pile 21 from beneath. Such a sheet-fed printing press 01 comprises, for example, a sheet feeder 19, at least one printing unit 37, in particular a non-impact printing unit 37, and at least one delivery 38. The at least one printing press 37 preferably comprises the at least one first print head 09, and more preferably also the at least one second print head 11. Preferably, at least one priming unit 39 is arranged along the transport path intended for the transport of printing substrate 02, upstream from the at least one printing unit 37, and is configured, for example, as a flexographic printing unit 39. Preferably, at least one coating unit 41 is arranged along the transport path intended for the transport of printing substrate 02, downstream from the at least one printing unit 37, and is configured, for example, as a flexographic printing unit 41. (This is also depicted schematically in FIGS. 2 and 3 by way of example.)

The embodiment of the printing press 01 comprising a conveyor belt 18, however, can also be utilized as a web-fed printing press 01 with appropriate feeding and/or removal of the printing substrate 02.

Figure 4:
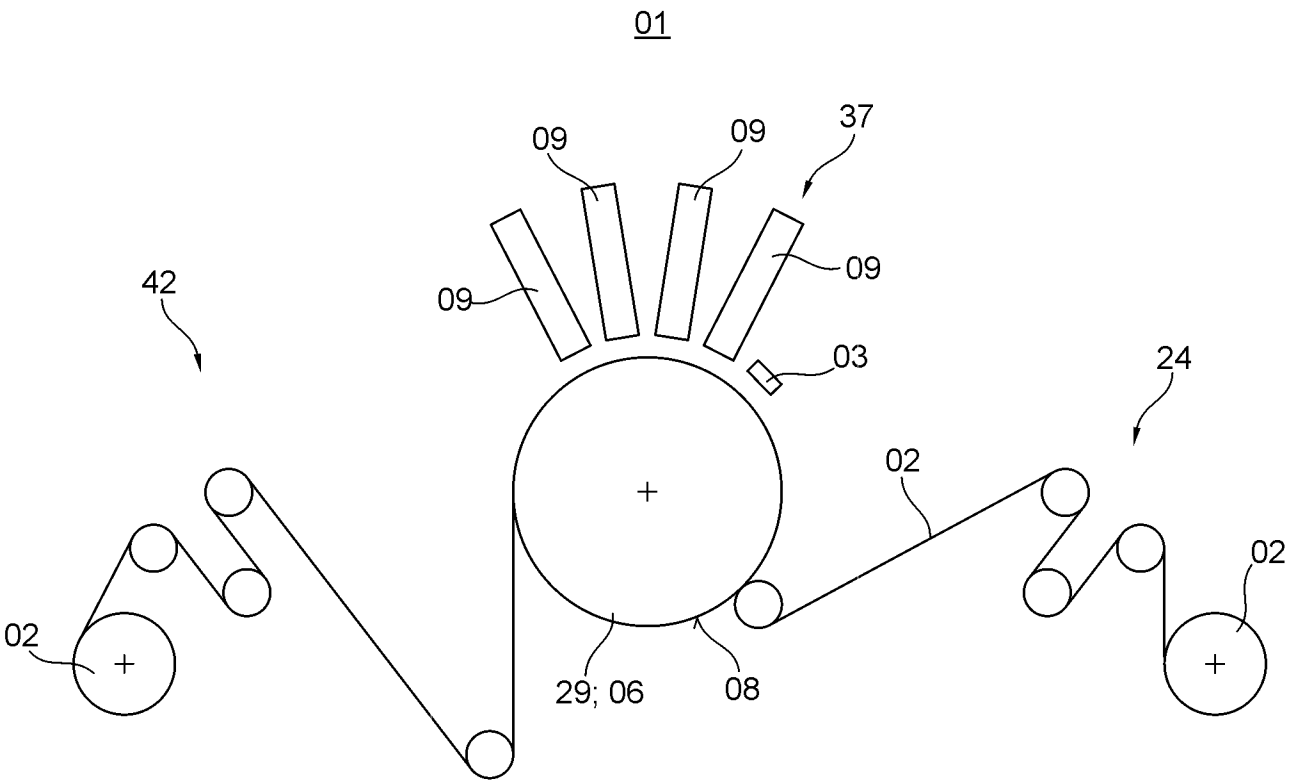
FIG. 4 a schematic illustration of a web-fed printing press comprising a central cylinder as support element.
Figure 5:
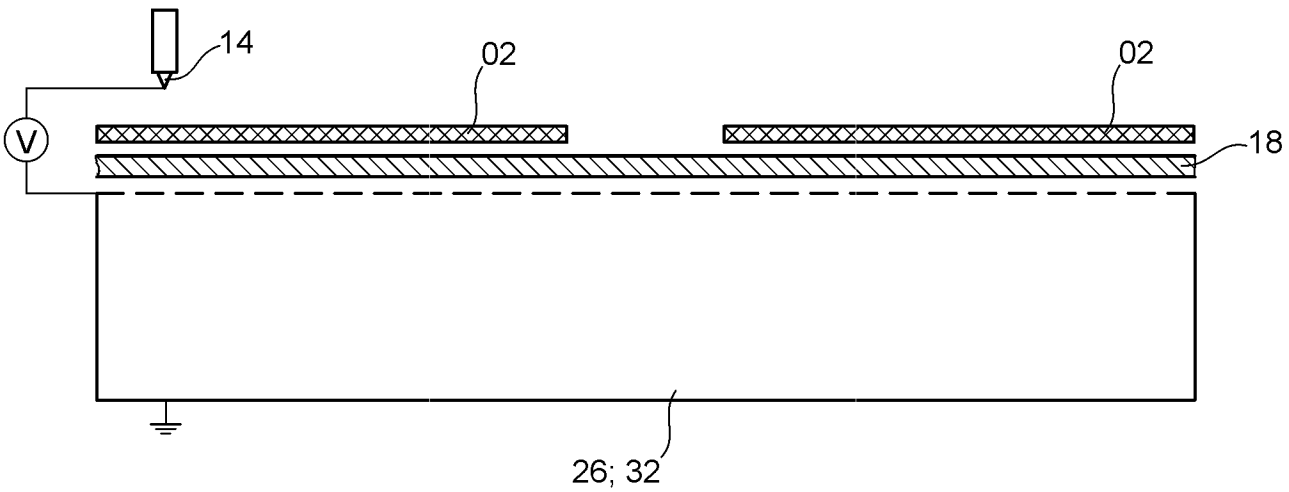
FIG. 5 a schematic illustration of electrodes of a charging device between which a voltage is present.

In another exemplary embodiment, the at least one circulatingly movable support element 07 is configured as a cylinder 29, in particular as a central cylinder 29. Preferably, the at least one first print head 09, and more preferably also the at least one second print head 11, are then in particular arranged so as to be directed radially at the cylinder 29 or central cylinder 20. The at least one first charging device 03 then preferably comprises the at least one first charging electrode 04, which, as viewed in the radial direction, is arranged outside the cylinder 29 or central cylinder 29. The at least one first charging device 03 then preferably comprises at least one counter-electrode 06, which is arranged radially within the cylinder 29 or central cylinder 29. For example, the printing press 01 is then configured as a web-fed printing press 01 and/or the printing press 01 then comprises at least one roll unwinding device 24 for web-format printing substrate 02, which is configured, for example, as a reel changer 24 for a flying reel change. The printing press 01 preferably comprises a substrate output device 42, which is configured, for example, as a winding device 42 and/or a cutting device 42 and/or a folding device 42. Web-format printing substrate 02 can, for example, be transported by means of diverting, actively or passively driven rollers and/or cylinders and/or fixed guide elements and/or conveyor belts and/or suction systems. (This is also depicted schematically in FIG. 4 by way of example.)

The embodiment comprising a cylinder 29 can also preferably be utilized as a sheet-fed printing press 01 with appropriate feeding and/or removal of the printing substrate 02, and optionally further holding elements.

Although the disclosure herein has been described in language specific to examples of structural features and/or methodological acts, it is to be understood that the subject matter defined in the appended claims is not necessarily limited to the specific features or acts described in the examples. Rather, the specific features and acts are disclosed merely as example forms of implementing the claims.

The invention claimed is:

1. A printing press comprising at least one circulatingly movable support element, which includes a circulatingly movable contact surface intended for contact with a printing substrate, and the printing press further comprising at least one first print head configured as an ink jet print head, whose at least one ejection opening is arranged so as to be directed at the at least one support element, and the printing press comprising at least one first charging device, and the at least one first charging device comprising at least one charging electrode, which is arranged so as to be directed at the contact surface, and the at least one first charging device comprising at least one counter-electrode, and the contact surface being at least partially arranged between the at least one charging electrode and the at least one counter-electrode of the at least one first charging device, characterized in that a smallest distance between the at least one charging electrode of the first charging device and the contact surface is greater than a smallest distance between an ejection opening of the at least one first print head and the contact surface, and that the smallest distance between the at least one charging electrode of the first charging device and the contact surface is at least 50 mm.

2. The printing press according to claim 1, characterized in that the smallest distance between the at least one charging electrode of the first charging device and the contact surface is at least 60 mm or at least 65 mm or at least 70 mm, and/or that the smallest distance between each charging electrode of the first charging device and the contact surface is at least 50 mm or at least 60 mm or at least 65 mm or at least 70 mm.

3. The printing press according to claim 1, characterized in that at least one first position sensor is provided, by means of which a height position of a printing substrate relative to the contact surface can be ascertained.

4. The printing press according to claim 1, characterized in that first the at least one first charging device, and thereafter the at least one first print head, are arranged along a transport path intended for a transport of printing substrate.

5. The printing press according to claim 4, characterized in that at least one detection zone of the at least one first position sensor is arranged along the transport path intended for a transport of printing substrate, downstream from the at least one first print head.

6. The printing press according to claim 1, characterized in that at least one second charging device is arranged along the transport path intended for a transport of printing substrate, downstream from the at least one first print head, and at least one second print head is arranged thereafter.

7. The printing press according to claim 1, characterized in that the at least one circulatingly movable support element is configured as a conveyor belt and/or as a suction conveyor belt.

8. The printing press according to claim 7, characterized in that the printing press comprises at least one bracing device, which includes a sliding surface bracing the at least one conveyor belt, and that the at least one bracing device is arranged so as to act as the at least one counter-electrode.

9. The printing press according to claim 6, characterized in that a transport path intended for the transport of printing substrate extends in a substantially flat manner, at least from the charging electrode of the first charging device to the at least one second print head.

10. The printing press according to claim 1, characterized in that the printing press is configured as a sheet-fed printing press.

11. The printing press according to claim 1, characterized in that a smallest distance between each charging electrode of the first charging device and the contact surface is greater than a smallest distance between an ejection opening of the at least one first print head and the contact surface.

12. The printing press according to claim 1, characterized in that a voltage of at least 25 kV or at least 30 kV or at least 35 kV is present between the at least one charging electrode and the at least one counter-electrode of the first charging device and/or that a voltage of no more than 45 kV or no more than 40 kV is present between the at least one charging electrode and the at least one counter-electrode of the first charging device.

13. The printing press according to claim 1, characterized in that the at least one first charging device is configured as a DC charging device.

14. The printing press according to claim 1, characterized in that at least one first field strength sensor for measuring an electric field strength is arranged along the transport path intended for the transport of printing substrate, downstream from the at least one first charging device and/or downstream from the at least one first print head.

15. The printing press according to claim 1, characterized in that the transport path intended for the transport of printing substrate has a minimum radius of curvature of at least 2 meters or at least 5 meters or at least 10 meters and/or at least 50 meters, at least from the charging electrode of the first charging device to the at least one first print head.

* * * * *